US012569714B2

(12) United States Patent
Nolan et al.

(10) Patent No.: US 12,569,714 B2
(45) Date of Patent: Mar. 10, 2026

(54) TILTING SMITH EXERCISE MACHINE WITH MOVABLE STRUCTURES

(71) Applicant: Bulletproof Fitness Equipment Inc, Acton, CA (US)

(72) Inventors: Nicole Kimberly Nolan, Santa Clarita, CA (US); Lawrence R. Nolan, Santa Clarita, CA (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 174 days.

(21) Appl. No.: 18/607,134

(22) Filed: Mar. 15, 2024

(65) Prior Publication Data

US 2024/0307729 A1 Sep. 19, 2024

Related U.S. Application Data

(60) Provisional application No. 63/452,623, filed on Mar. 16, 2023.

(51) Int. Cl.
*A63B 21/078* (2006.01)
*A63B 21/06* (2006.01)
*A63B 21/062* (2006.01)

(52) U.S. Cl.
CPC ..... *A63B 21/078* (2013.01); *A63B 21/0615* (2013.01); *A63B 21/0626* (2015.10)

(58) Field of Classification Search
CPC ..... A63B 21/078; A63B 21/0615; A63B 21/0626; A63B 21/0783; A63B 2244/09
See application file for complete search history.

(56) References Cited

U.S. PATENT DOCUMENTS 4,795,149 A * 1/1989 Pearson ..... A63B 21/078 482/133
5,215,510 A * 6/1993 Baran ..... A63B 21/0626 482/45
5,669,859 A * 9/1997 Liggett ..... A63B 21/0626 482/94
6,811,521 B1 * 11/2004 Musso ..... A63B 21/0626 482/137
7,374,516 B2 * 5/2008 Lundquist ..... A63B 21/078 482/106
7,909,743 B1 * 3/2011 Webber ..... A63B 21/078 482/94
8,328,698 B1 * 12/2012 Webber ..... A63B 21/4043 482/106

(Continued)

*Primary Examiner* — Loan B Jimenez
*Assistant Examiner* — Kathleen M Fisk
(74) *Attorney, Agent, or Firm* — Avek IP, LLC

(57) ABSTRACT

A tilting smith exercise machine includes a support frame with an upper horizontal rail and a lower horizontal rail; and a movable structure extending from a top end to a bottom end, the movable structure having a vertical support; a top trolley positioned at the top end and coupled to the upper horizontal rail, the top trolley having a side angled track and a rear angled track; a bottom trolley positioned at the bottom end and having actuators extending from the bottom trolley to the vertical support, a first hinge to allow the vertical support to pivot from side to side, and a second hinge allowing the vertical support to pivot from front to back; and a user engageable system supported by the vertical support, the user engageable system is to be operated by a user as the user performs an exercise.

18 Claims, 12 Drawing Sheets

(56) References Cited

U.S. PATENT DOCUMENTS

| | | | | |
|---|---|---|---|---|
| 10,646,740 | B2 * | 5/2020 | Lee | A63B 21/0724 |
| 10,864,400 | B2 * | 12/2020 | Schween | A63B 21/0724 |
| 12,161,907 | B2 * | 12/2024 | Jones | A63B 21/0059 |
| 2022/0219033 | A1 | 7/2022 | Lee | |

* cited by examiner

TILTING SMITH EXERCISE MACHINE WITH MOVABLE STRUCTURES

RELATED APPLICATIONS

This application claims priority to U.S. provisional application No. 63/452,623 filed Mar. 16, 2023, which is incorporated by reference in their entireties herein.

FIELD OF INVENTION

The disclosure relates generally to exercise equipment. More specifically, the disclosure relates to a tilting smith exercise machine with movable structures to allow for movement along a plurality of planes with a plurality of user engageable devices, thereby allowing for diversity of use.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a tilting smith exercise machine, comprising a support frame having a plurality of vertical posts and a plurality of horizontal posts; an upper horizontal rail supported by the support frame; a lower horizontal rail supported by the support frame; and a first movable structure extending from a top end to a bottom end. The movable structure includes a vertical support extending from the top end to the bottom end; a top trolley positioned at the top end of the vertical support and coupled to the upper horizontal rail, the top trolley having a side angled track, and a rear angled track; a bottom trolley positioned at the bottom end of the vertical support, the bottom trolley having one or more actuators extending from the bottom trolley to the vertical support, a first hinge connecting the bottom trolley to the vertical support to allow the vertical support to pivot from side to side, and a second hinge connecting the bottom trolley to the vertical support and allowing the vertical support to pivot from front to back. The invention further includes a user engageable system supported by the vertical support. The top end of the vertical support is supported by the side angled track and the rear angled track when the vertical support is pivoted from side to side and from front to back; and the user engageable system is configured to be operated by a user as the user performs an exercise.

According to another embodiment of the current disclosure, the invention also includes a movable structure as part of a tilting smith exercise machine, the movable structure comprising a vertical support extending from a top end to a bottom end, a top trolley positioned at the top end of the vertical support, and a bottom trolley positioned at the bottom end of the vertical support. The top trolley includes a side angled track and a rear angled track. The bottom trolley includes one or more actuators extending from the bottom trolley to the vertical support, a first hinge connecting the bottom trolley to the vertical support to allow the vertical support to pivot from side to side, and a second hinge connecting the bottom trolley to the vertical support and allowing the vertical support to pivot from front to back.

A user engageable system is coupled to the vertical support. The top end of the vertical support is supported by the side angled track and the rear angled track when the vertical support is pivoted from side to side and from front to back, and the user engageable system is configured to be operated by a user as the user performs an exercise.

BRIEF DESCRIPTION OF THE DRAWINGS

Embodiments of the invention are described in detail below with reference to the attached drawings.

LIST OF REFERENCE NUMBERS

Figure 1:
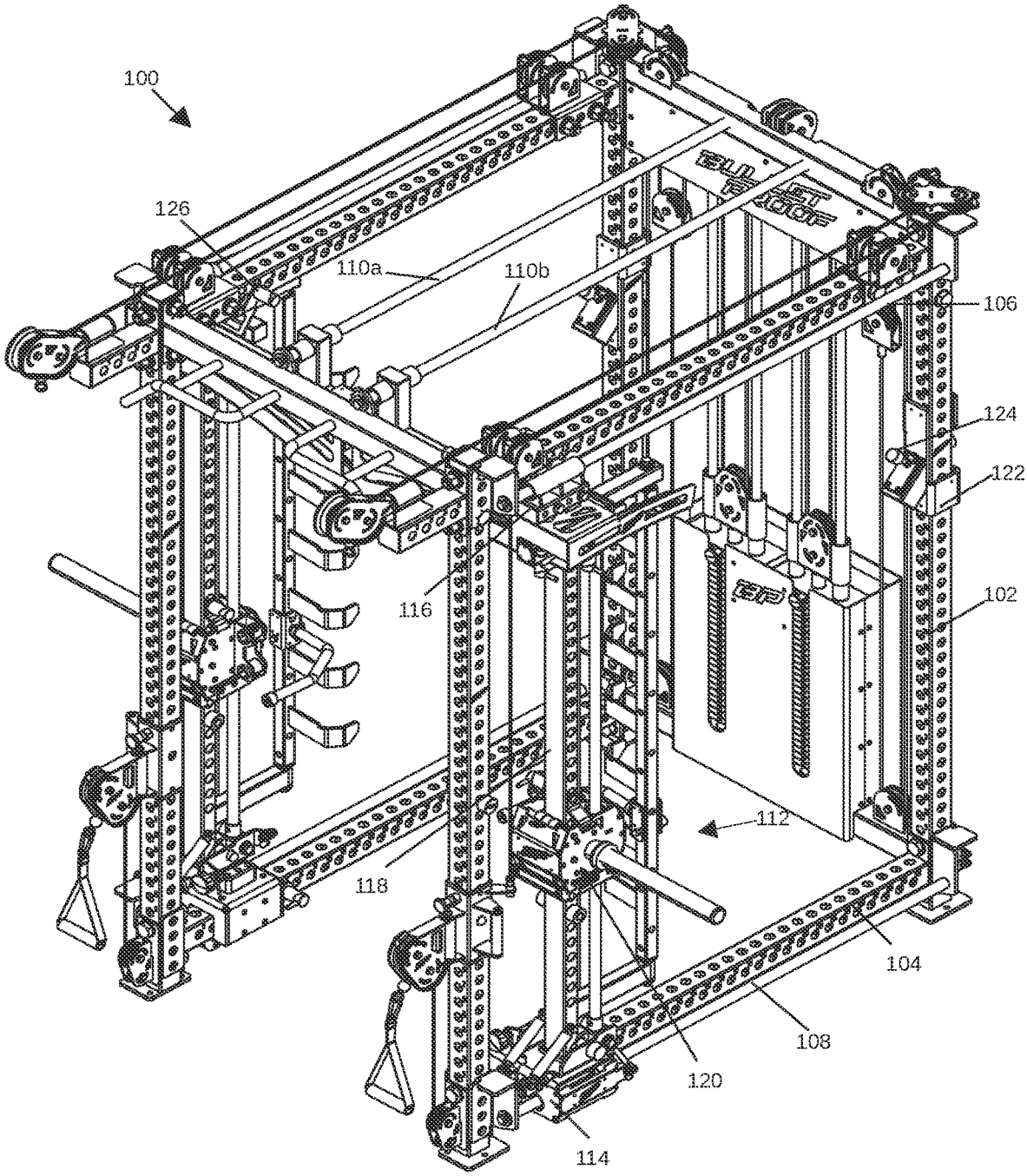
FIG. 1 is an angled view of a tilting smith exercise machine in accordance with the present invention.

100—Tilting Smith Machine
102—Vertical Post(s)
104—Horizontal Post(s)
106—First Upper Horizontal Rail
108—First Lower Horizontal Rail
110*a-b*—Central Horizontal Rails
112—First Movable Structure
114—Bottom Trolley
116—Top Trolley
118—Vertical Support
120—User Engageable System
122—Bracket
124—Locking Bolt
126—Pull Pin
200—Second Movable Structure
201—Top End
202—Tubular Guide
204—Tubular Guide
203—Bottom End
206—Vertical Rail
208—Carriage
210—Tubular Guide
212—Bar
214—Stop Pin
216—Pair of Gas Spring Actuators
218—First Hinge System

220—Second Hinge System
222—Side Angled Track
223—Side Angled Track Channel
224—Latch
226—Rear Angled Track
228—Wheel
230—Pull Pin
232—Attachment Ports
234—Locking Pin
236—Vertical Latch Assembly
238—Plurality of Hooks
240—Handle Attachment
242—Secondary Tubular Guide(s)
300—Top Horizontal Support Member
302—Bottom Horizontal Support Member
600—Barbell Attachment
602—Squat Hack Pad and Leg Press Platform Attachment
604—Pair of Connectors
606—Pair of Connectors
608—Barbell
610—Pad System
612—Handle(s)
800—Hook
802—Axis of Rotation
804—Hook
806—Axis of Rotation
900—Locking Pin
1000—Handle
1002—Handle
1102—Locking Pin
1200—Locking Pin
1202—Wheel The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art. One known machine is commonly referred to as a "Smith Machine", which generally includes a support structure supporting a barbell such that the barbell is lifted along tracks. Accordingly, the smith machine is generally used for exercises requiring one plane of motion (vertically up and down), such as bench press and squats, among others.

The present invention provides for a tilting smith exercise machine, which comprises a frame or support structure having a plurality of horizontal rails to support a left-side movable structure and a right-side movable structure. The movable structures are designed such that movement can be completed in a plurality of planes, with various attachments and different grips, such that the machine can be used for a wide array of exercise variations targeting both upper and lower body muscle groups. Accordingly, the present invention provides for a diverse workout with just one machine and a plurality of user engageable attachments.

The moveable structures are discussed herein, and as shown, are substantially identical to one another, or are mirror images of one another. Accordingly, although features may be pointed to or explained for one of the left or ride moveable structures, the same feature applies to both moveable structures as would be understood by those skilled in the art.

In FIG. 1, the tilting smith exercise machine 100 is shown having a frame or support structure for supporting various components. The frame may vary but includes vertical posts 102 and horizontal posts 104 to create the support structure. The overall size and materials of the frame can vary based on manufacturing, aesthetical, or functional considerations. The posts 102, 104 may include a plurality of apertures for selectively receiving equipment, such as via one or more locking pins. The frame also supports a plurality of horizontal rails, for example a first upper horizontal rail 106 and a first lower horizontal rail 108, as well as central horizontal rails 110*a*, 110*b*. The rails provide for support of movable structures as discussed below. In embodiments, the rails are tubal in shape, however, those skilled in the art may adapt various modifications based on their specific needs without departing from the present invention.

A first movable structure 112 is positioned between and engaged with upper horizontal rail 106 and lower horizontal rail 108. The movable structure 112 includes a vertical support 118 that extends substantially between a top end 201 and a bottom end 203 and the movable structure 112 is configured to engage with the rails via a top trolley 116 and a bottom trolley 114. The movable structure 112 is configured to be manipulated into different positions and receive one of a plurality of different user engageable devices such that the movable structure 112 can support many different exercises. In other words, the user can select a user engageable device, adjust the movable structures, add the user engageable device to the movable structures, and perform one or more exercises. The system can be repeatedly readjusted, with different devices added, such that a full and complete workout can take place using just the system of the present invention.

Figure 3:
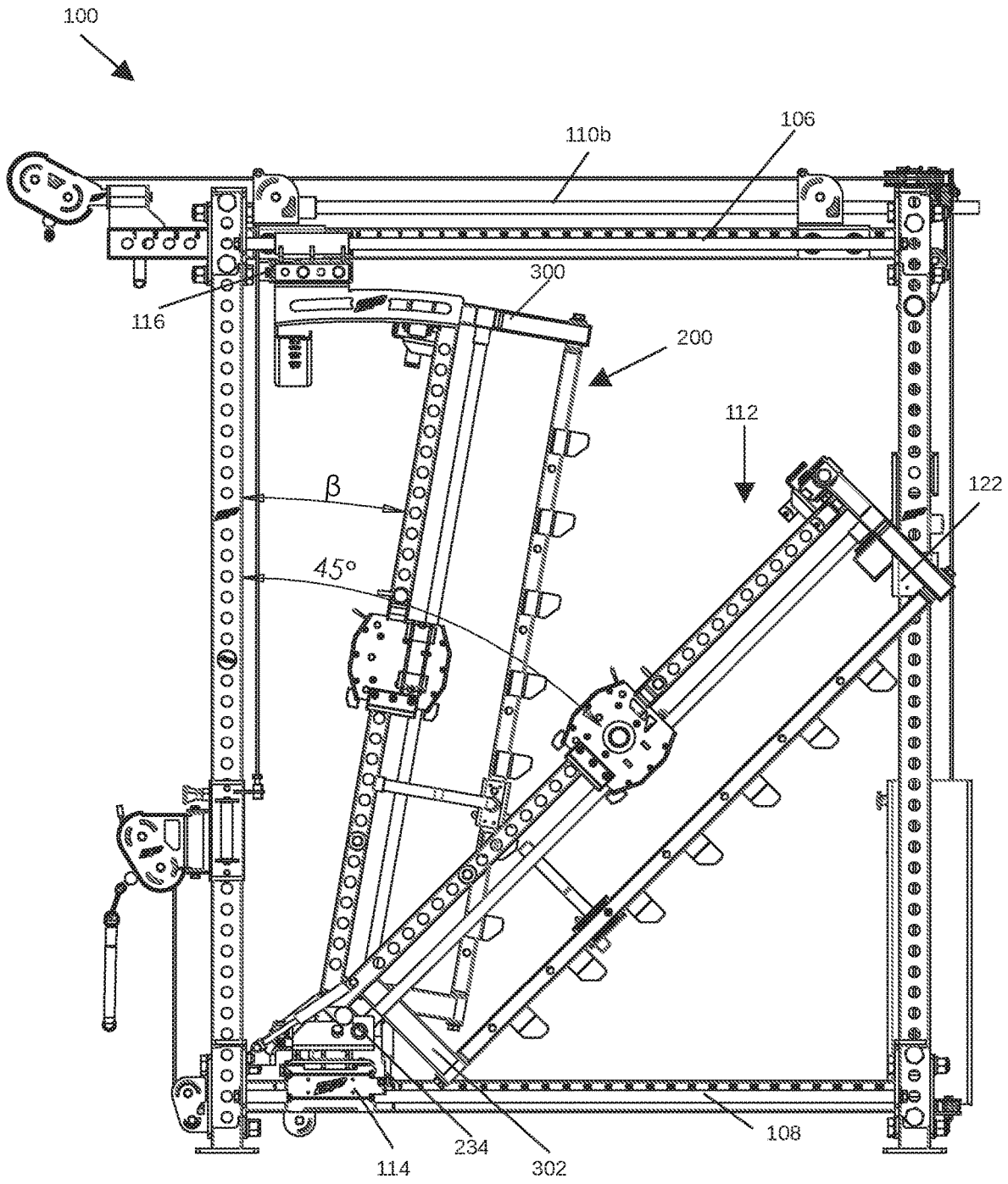
FIG. 3 is a side view of the tilting smith exercise machine of FIG. 1 with the movable structures pivoted back.

A user engageable system 120 is coupled to the vertical support 118 and is configured to be operated by a user for various exercises. Also shown in FIG. 1 is a bracket 122 with locking bolt 124 to support the movable structure 112 when in a fully backward pivoted position (as shown in FIG. 3). A locking pin 126 is used to lock the associated movable structure 112 into a fully vertical position. The locking pin 126 of each movable structure will extend into an aperture of one of the upper horizontal posts of the frame, thereby locking the movable structure in a fully vertical position (as shown in at least FIG. 1).

Figure 2:
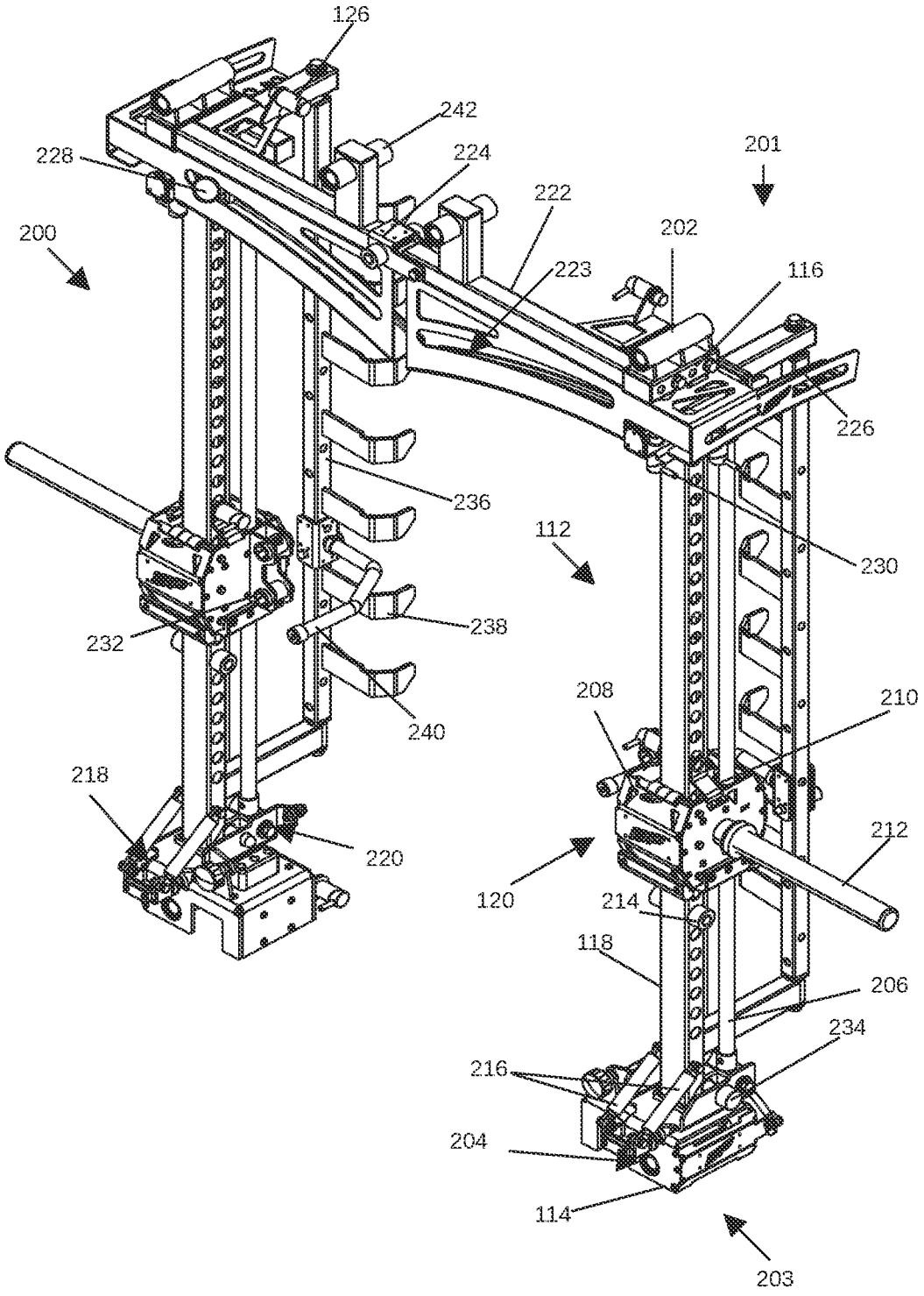
FIG. 2 is an angled view of a first movable structure and a second movable structure as part of the tilting smith exercise machine of FIG. 1.

In FIG. 2, the left movable structure 200 and right movable structure 112 are shown. Again, although the figures do not include labeled components on both movable structures, the features are interchangeable between the two or are mirror images between the two. The movable structure 112 includes an upper tubular guide 202 as part of the top trolley 116 and a lower tubular guide 204 as part of the bottom trolley 114. The guides are configured to receive rail 106 and rail 108 respectively. Although the rails and tubular guides are shown being substantially circular in shape/cross section, those skilled in the art will appreciate that alternative shapes may be used.

A vertical rail 206 also extends between the top trolley 116 and the bottom trolley 114. The vertical rail 206 runs parallel to and near the vertical support 118 and is engaged with the bottom trolley 114 at a hinge 220, therefore allowing for the movable structure 112 to pivot backward (shown in FIG. 4). The hinge 220 can vary as would be known by those in the art, but regardless provides for pivoting forward and backward of the movable structure 112. In embodiments, the user engageable system 120 also includes a carriage 208 supporting rollers such that the carriage 208 can traverse along the vertical support 118. In addition, the carriage 208 supports a tubular guide 210 for engagement with the vertical rail 206. Accordingly, the carriage 208 ties the vertical support 118 and the vertical rail 206 together. Embodiments include a stop pin 214 extending through a selected aperture of the vertical support 118 for blocking the carriage 208 from falling below a specified height. A bar 212 is shown engaged with the carriage 208, which may be used to receive weights or used as a handle for manipulation by the user. The carriage 208 also supports a pair of attachment ports 232 for receiving an attachment. The attachment ports 232 are hexagonal in shape and are substantially perpendicular to the bar 212. The ports 232 are also open from both ends, thereby again allowing for diverse angles and means of attachment of user engageable devices.

Figure 4:
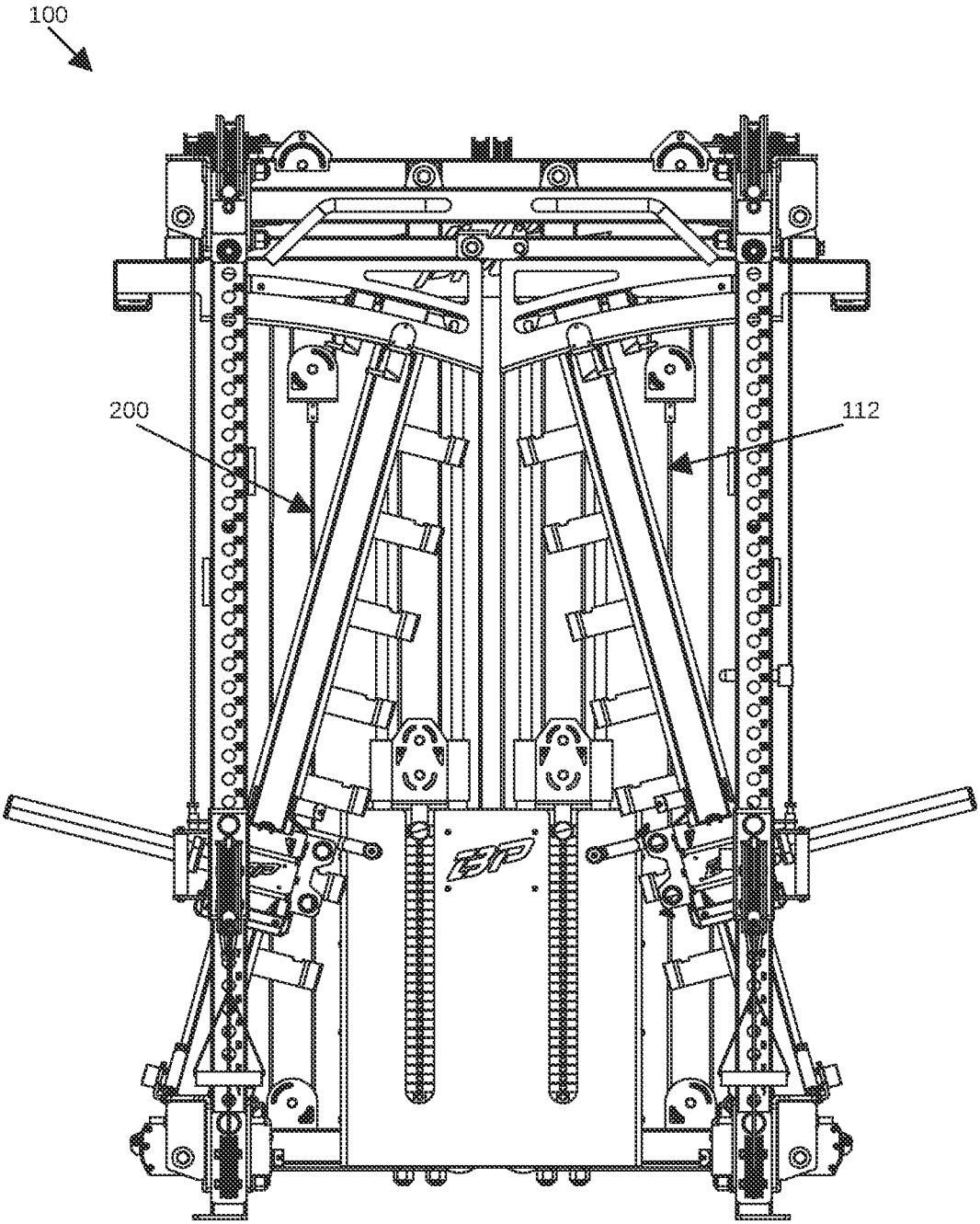
FIG. 4 is a front view of the tilting smith exercise machine of FIG. 1 with the movable structures pivoted inward.

The top trolley 116 includes a side angled track 222 to allow for side-to-side pivoting of the movable structure 112 and a rear angled track 226 to allow for front-to-back pivoting of the movable structure. In embodiments, wheels 228 or alternative rolling devices are used to provide for movement within the tracks. A latch 224 is used to lock the top trolleys together, the latch configured to fold down via a hinging point and lock into place such that the top trolleys are locked together. The side angled track 222 include a gradually angled downward channel 223 which guides the wheel or rolling device as the associated movable structure pivots from side to side (as shown in FIG. 4).

Secondary tubular guides 242 engage with the center horizontal rails 110*a-b* for providing additional support of the movable structures. Another pull pin 230 is used to lock the movable structure 112 in the vertical position, this pull pin 230 releasably protruding in front of one of the upright posts such that the movable structure 112 is locked in a forward/vertical position.

The bottom trolley 114 includes hinges 218, 220 that allow for the side to side and back to front pivoting of the moveable structure. The hinge systems 218, 220 can vary as would be understood by those skilled in the art. A locking pin 234 is used to lock the system vertically. The locking pin 234 inserting through a bracket system such that backward pivoting is unavailable when the locking pin 234 is there inserted.

Each bottom trolley 114 also includes a pair of gas spring actuators 216 which extend from the trolley 114 to the vertical support 118. These actuators 216 provide resistance against the vertical support 118 and are configured to rotate around their point of connection to the trolley 114, and accordingly, may extend into varying lengths such that the vertical support 118 can be so supported in different angles. These actuators 216 aid the user in making adjustments, such that the user is not required to fully support the movable structure 112 on their own.

Each movable structure also includes a vertical latch assembly 236 with another vertical member supporting a plurality of hooks 238 extending inwardly. A handle attachment 240 is provided such that the user can more easily manipulate the movable structure. The handle attachment 240 is removable from the vertical latch assembly 236.

Accordingly, the movable structures can be adjusted from front to back as well as from left to right. The user engageable system of each structure also includes the pair of attachment ports 232, which in embodiments have a hexagonal cross shape to create a tight lock against user engageable attachments. Therefore, the user will alter a position of each movable structure, select a user engageable device, and proceed with a desired exercise. The user can repeatedly readjust the structures and add different user engageable attachments to proceed with additional exercises.

In FIG. 3 a side view demonstrates the movable structures 112, 200 in two altered positions. Movable structure 112 is fully released such that the entire structure rests fully backwards on the bracket 122. This position places the user engageable system at a 45 degree angle relative to a front upright of the frame. Movable structure 200 is shown at a partially angled position, wherein a top horizontal member 300 is slidingly engaged with the rear angled track. The horizontal member 300 slides out from the track to alter the angle relative to the front upright of the frame. Those skilled in the art will appreciate that the top horizontal member 300 can engage with the track and lock into various positions, such as via locking pins or the like. A bottom horizontal member 302 creates further structural integrity of the movable structure.

FIG. 4 is a front view depicts the movable structures 112, 200 angled inward via the side angled tracks.

In each of FIGS. 3 and 4, the actuators 216 are shown with adjusted lengths such that the movable structures are supported by the actuators 216 in each position. The hinge systems and actuators allow for the front to back adjustment as well as the side to side adjustment.

Figure 5:
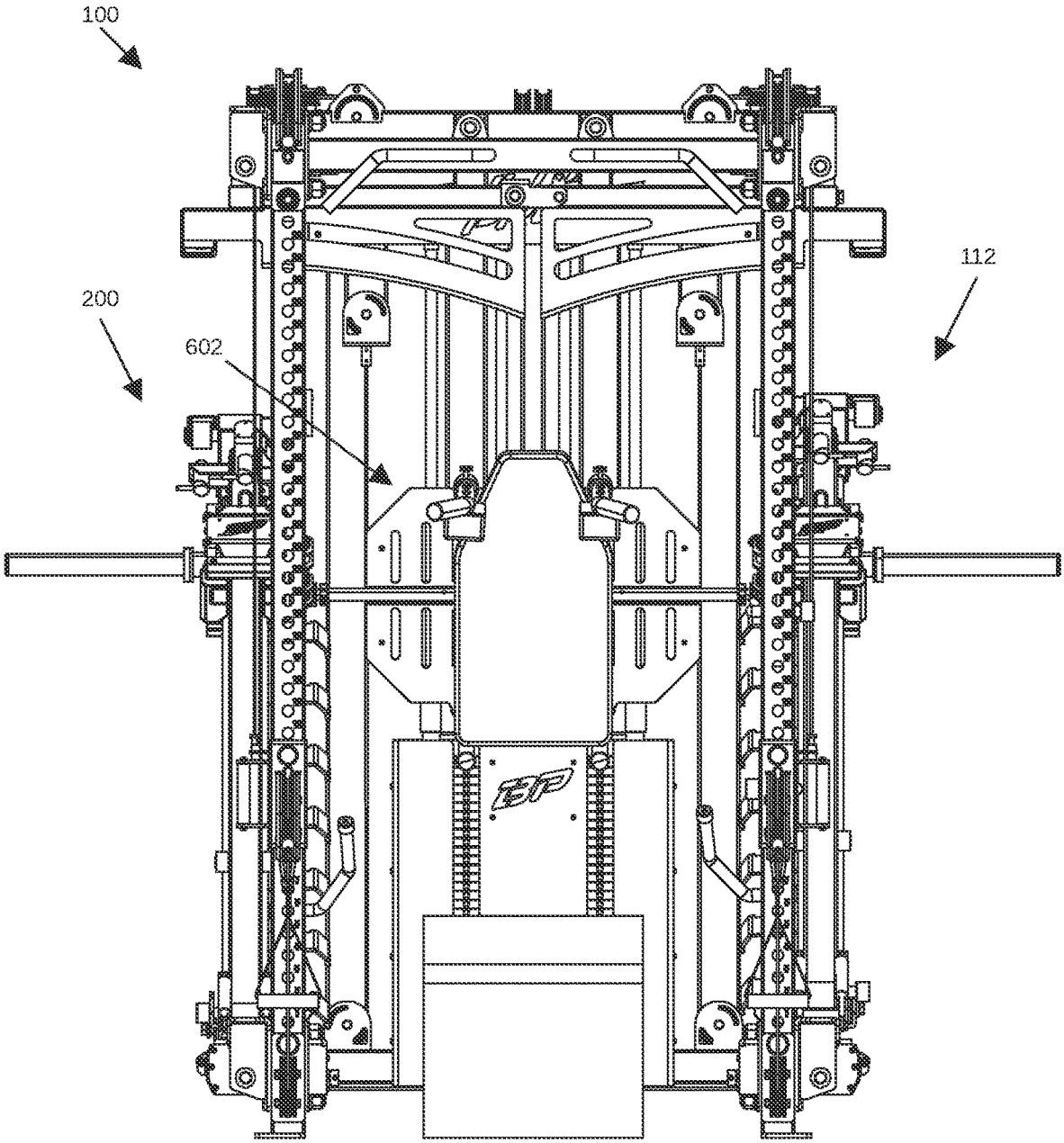
FIG. 5 is a front view of the tilting smith exercise machine of FIG. 1 with a squat hack pad and leg press platform attachment.

In FIG. 5, a front view depicts use of a squat hack pad and leg press platform attachment 602. This attachment is added to the ports of the user engageable systems of the movable structures.

Figure 6:
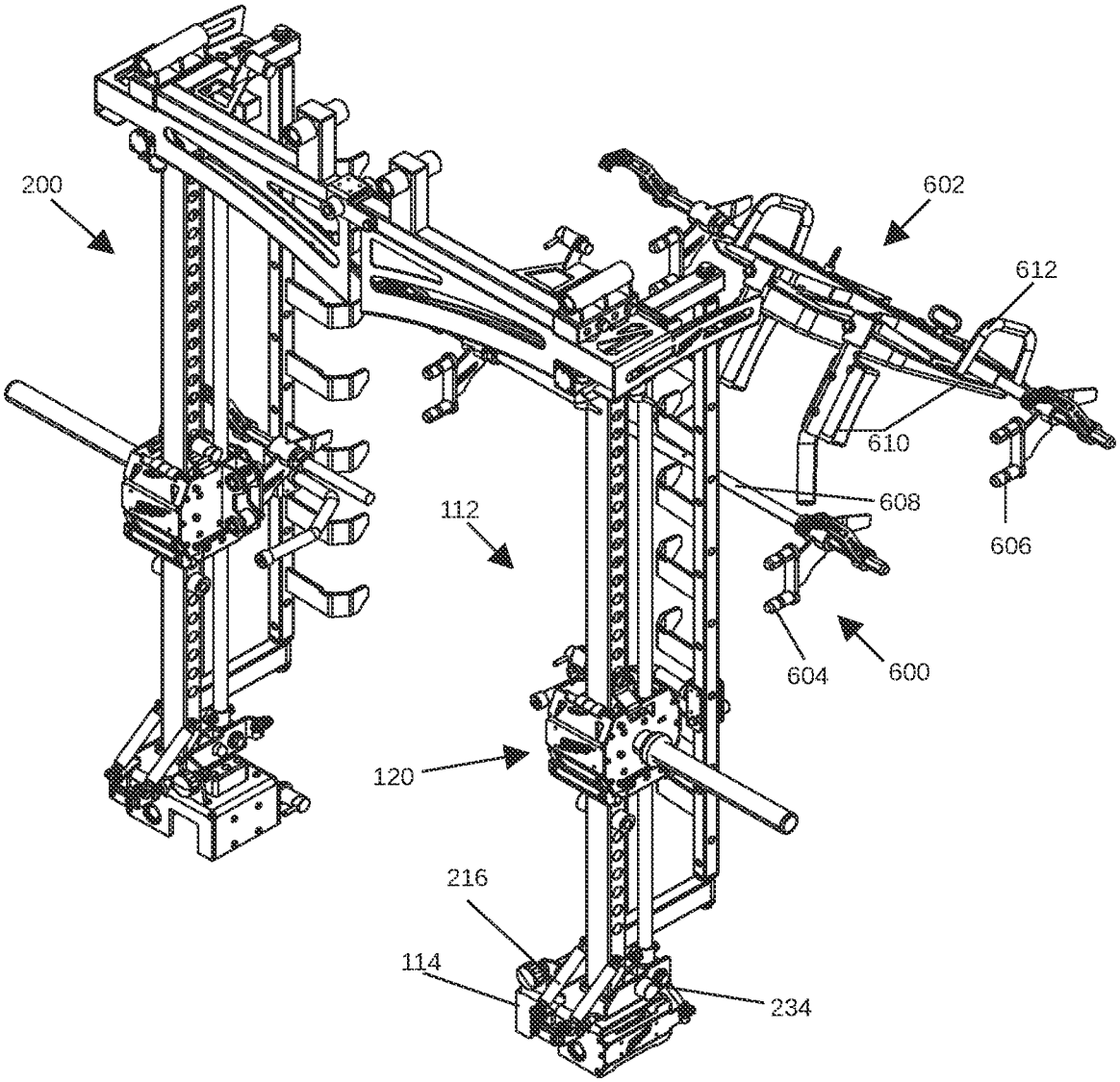
FIG. 6 is an angled view of the first and second movable structures showing a barbell attachment and the squat hack pad and leg press platform attachment.

In FIG. 6, an angled view shows a barbell attachment 600 as well as the squat hack pad and leg press platform attachment 602. The attachment are shown disconnected from the movable structures 200, 112 for clarity. Each attachment includes a pair of connectors 604, 606 for engagement with the pair of attachment ports 232 of the associated user engageable system. The barbell attachment 600 includes a barbell 608, whereas the squat hack pad and leg press platform attachment 602 includes a pad system 610 and one or more handles 612. Although only some user engageable attachments are shown, it is contemplated that any number of attachments may be developed for use with the present invention to further diversify the use of the machine.

Figure 7:
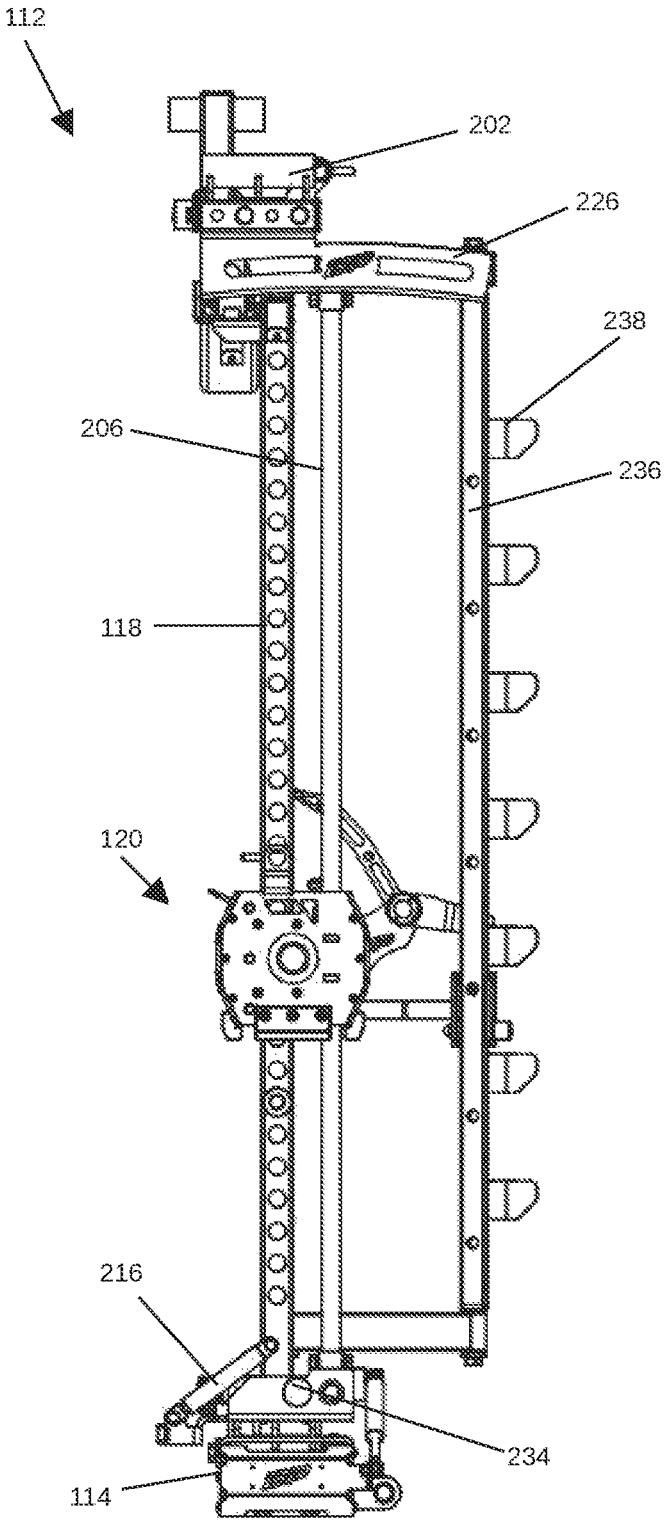
FIG. 7 is a side view of one of the movable structures.
Figure 8:
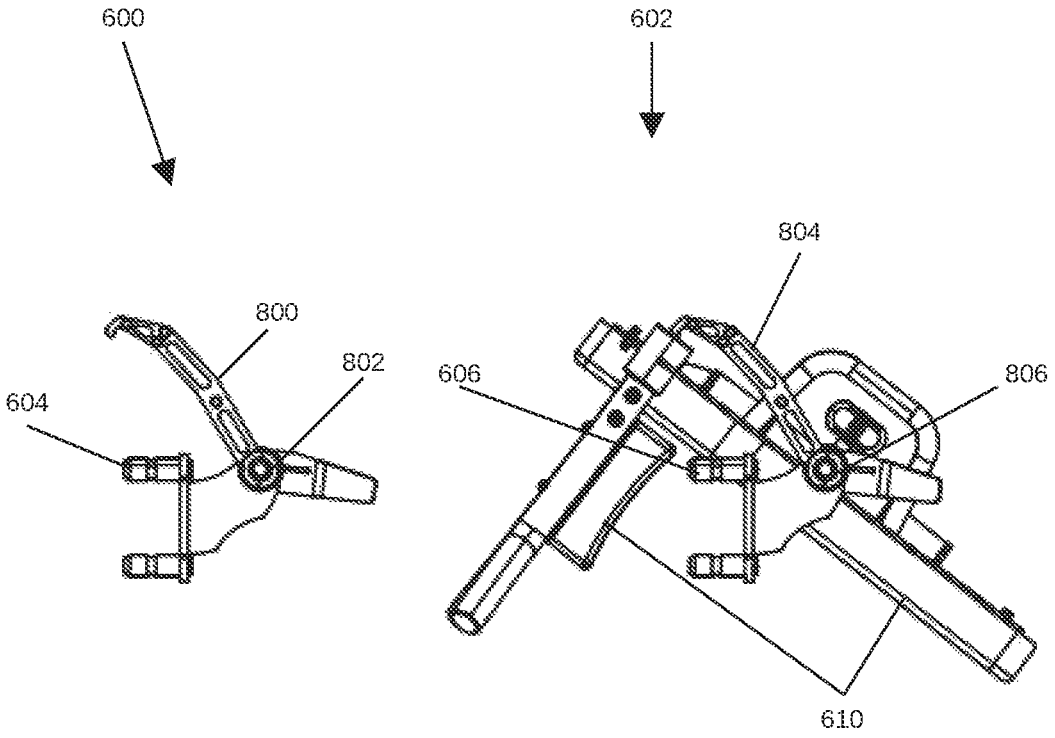
FIG. 8 is a side view of the barbell attachment and the squat hack pad and leg press platform attachment.

FIGS. 7 and 8 depict one movable structure as well as attachments 600, 602 for clarity. As shown in FIG. 8, each attachment also includes a hook 800, 804 with an axis of rotation 802, 806 to allow for the attachment to hook into the vertical supports, thereby locking the attachment at a position.

Figure 9:
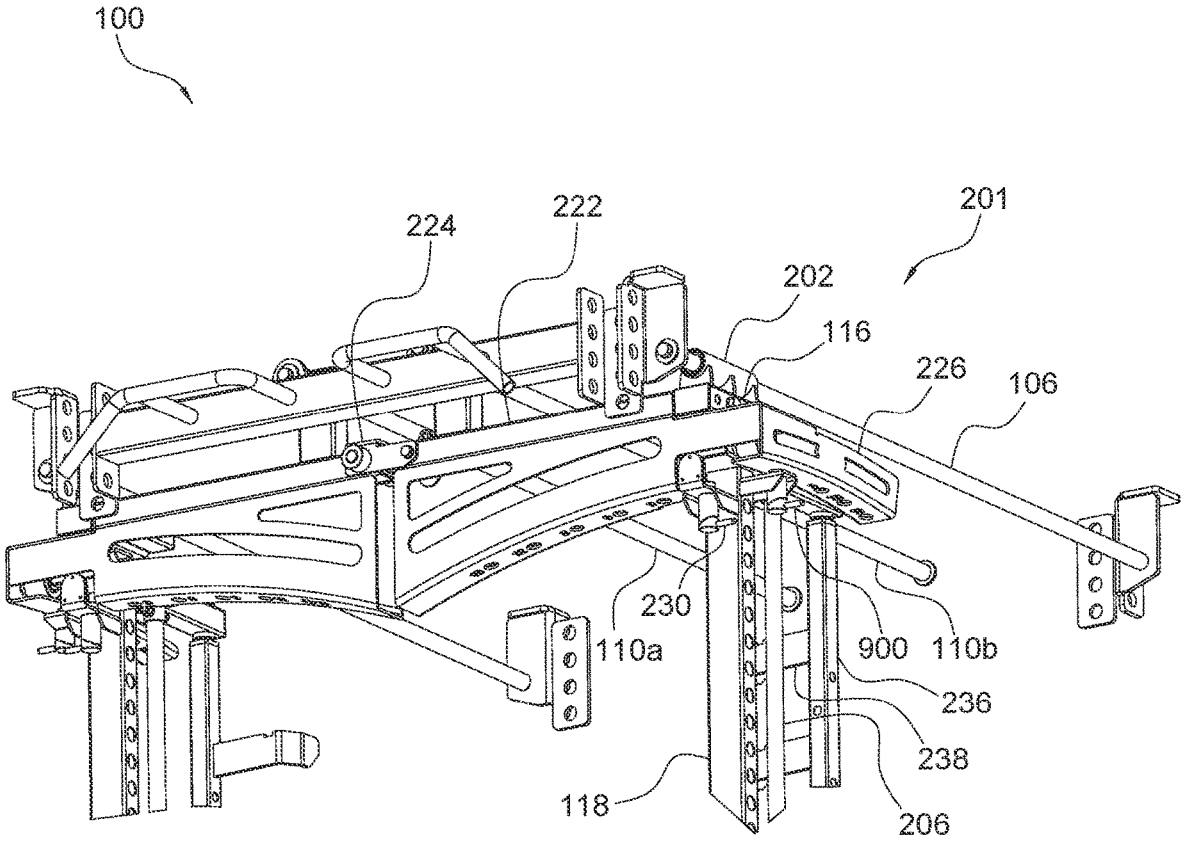
FIG. 9 is a bottom angled view of the tilting smith exercise machine of FIG. 1 showing the top trolleys.

In FIG. 9, a bottom angled view further depicts the top trolley 116 for clarity. This view better depicts locking pin 230 configured to lock into side angled track 222 within a selected aperture. Similarly, another locking pin 900 locks into one apertures of the rear angled track 226. Accordingly, these locking pins allow for the user to select a position to lock the movable structure into.

Figure 10:
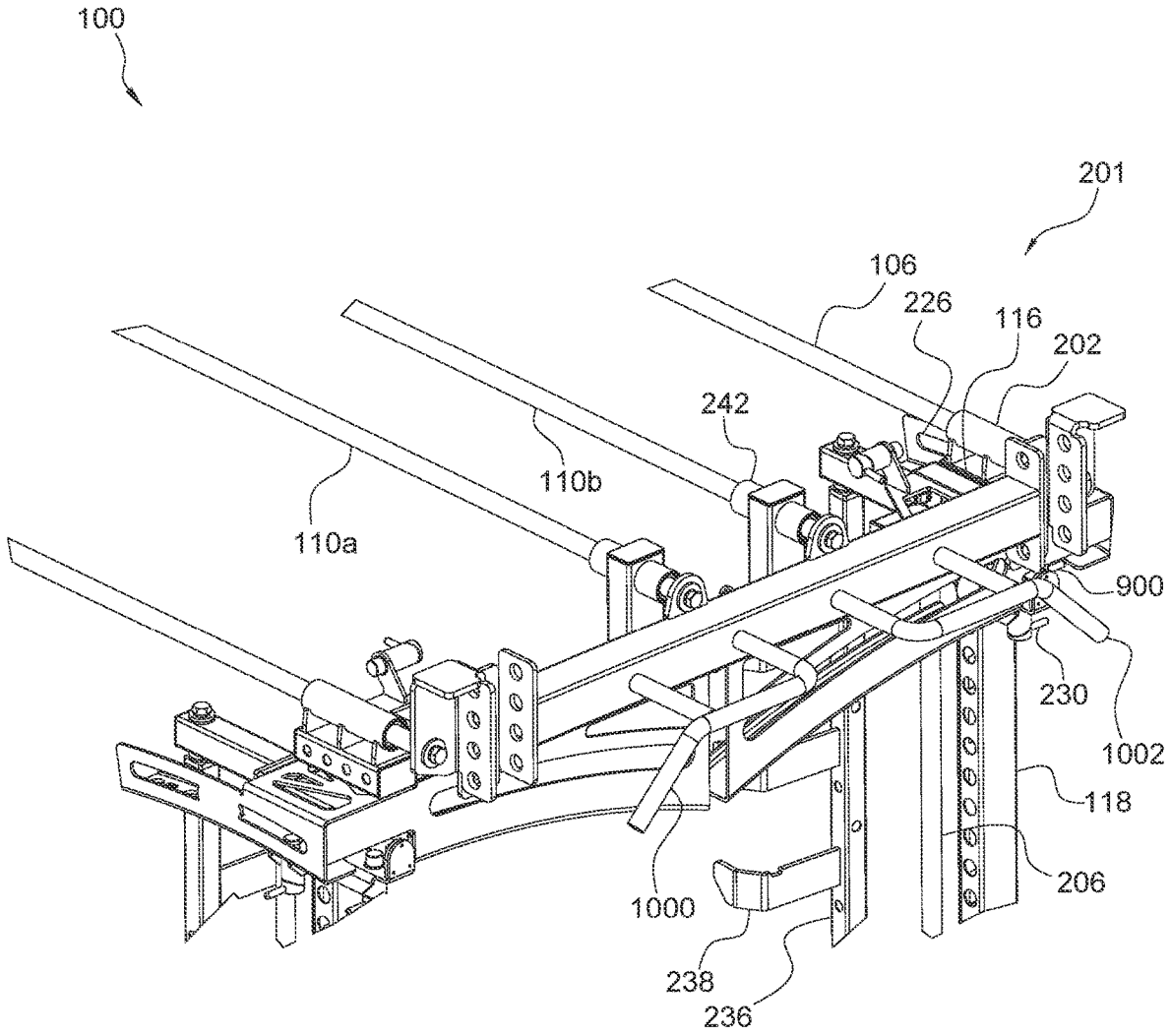
FIG. 10 is a left angled side view of the tilting smith exercise machine of FIG. 1 showing the top trolleys.

In FIG. 10, another top angled view depicts the top trolley 116 and other features of the present invention for clarity. As shown, a first side handle 1000 and a second side handle 1002 may attach to the machine to allow for additional exercises, such as pull ups.

Figure 11:
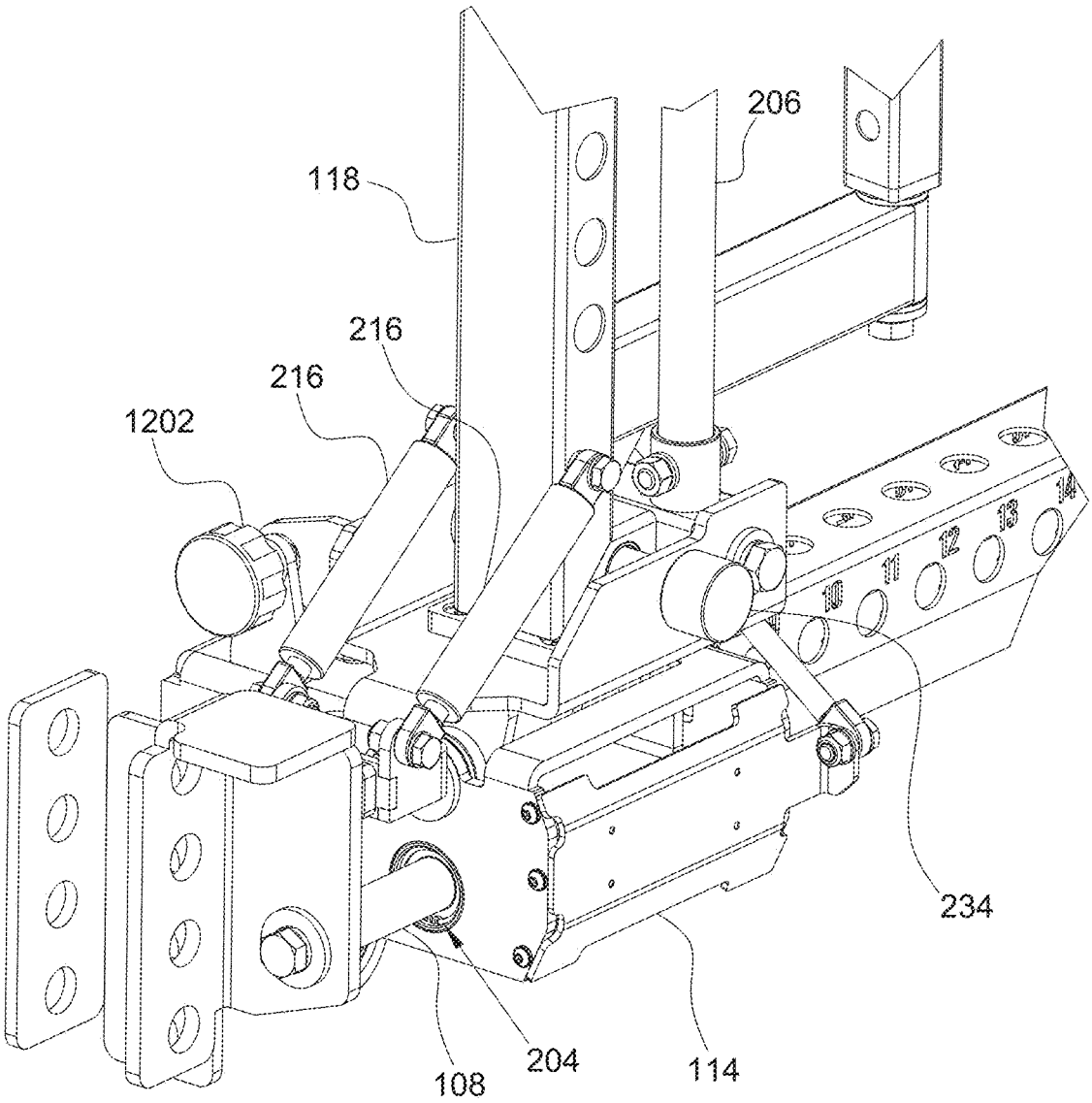
FIG. 11 is a close-up, first side angled view of the bottom trolley of the tilting smith exercise machine of FIG. 1
Figure 12:
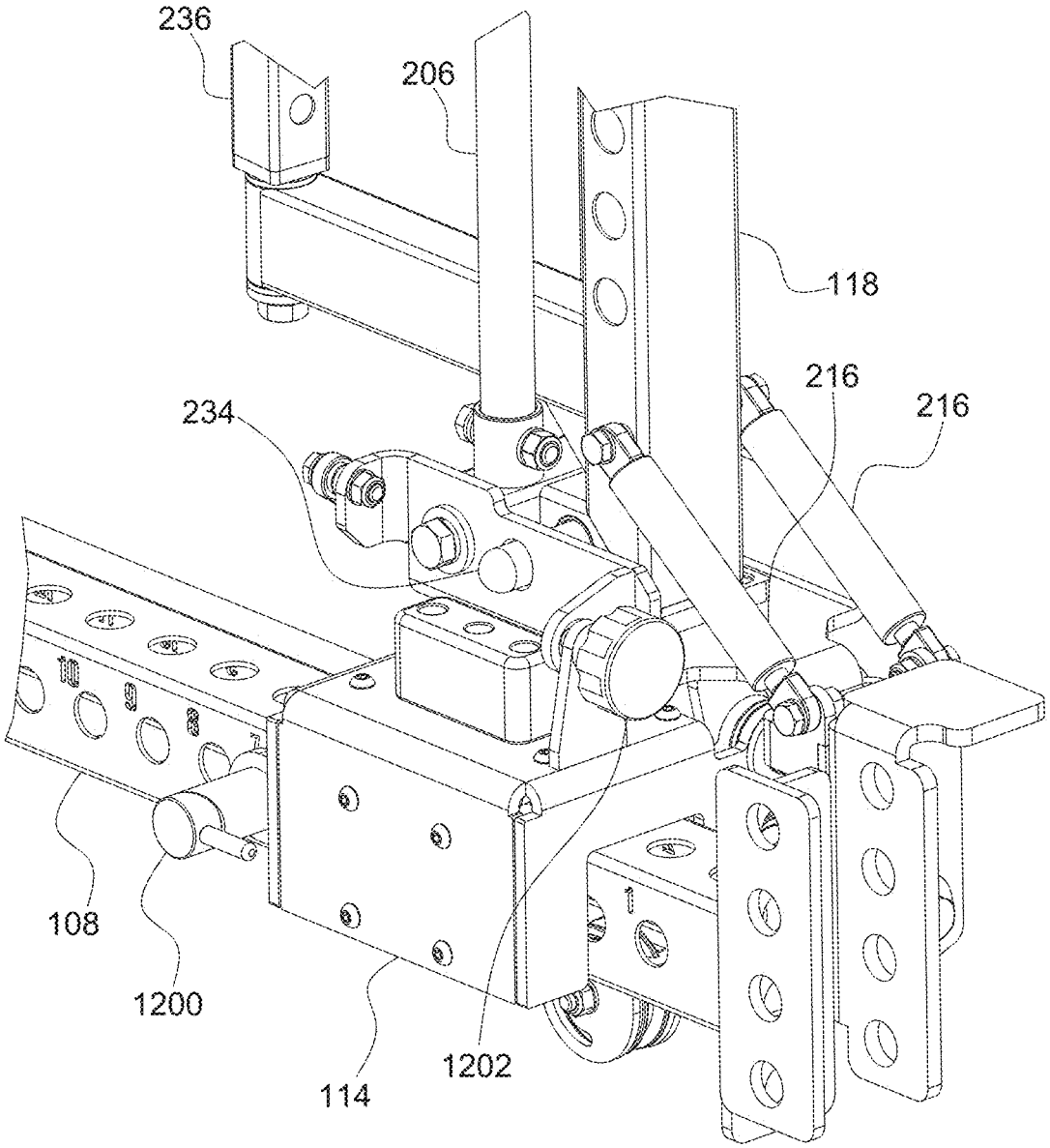
FIG. 12 is a close up, second side angled view of the bottom trolley of the tilting smith exercise machine of FIG. 1.

In FIGS. 11 and 12, angled views better depicts the bottom trolley 114 for clarity. Here again, locking pins 1200, 1202 are used to lock the movable structure into user desired positions.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A tilting smith exercise machine, comprising:

a support frame having a plurality of vertical posts and a plurality of horizontal posts;

an upper horizontal rail supported by the support frame;

a lower horizontal rail supported by the support frame; and a first movable structure extending from a top end to a bottom end, the first movable structure having:

a vertical support extending from the top end to the bottom end;

a top trolley positioned at the top end of the vertical support and coupled to the upper horizontal rail, the top trolley having a side angled track, and a rear angled track;

a bottom trolley positioned at the bottom end of the vertical support, the bottom trolley having one or more actuators extending from the bottom trolley to the vertical support, a first hinge connecting the bottom trolley to the vertical support to allow the vertical support to pivot from side to side, and a second hinge connecting the bottom trolley to the vertical support and allowing the vertical support to pivot from front to back; and a user engageable system supported by the vertical support;

wherein the top end of the vertical support is supported by the side angled track and the rear angled track when the vertical support is pivoted from side to side and from front to back; and wherein the user engageable system is configured to be operated by a user as the user performs an exercise.

2. The tilting smith exercise machine of claim 1, wherein the movable structure further comprises a vertical rail extending substantially between the top end and the bottom end, the vertical rail coupled to the top trolley and the bottom trolley.

3. The tilting smith exercise machine of claim 2, wherein the user engageable system is coupled to the vertical support and the vertical rail.

4. The tilting smith exercise machine of claim 1, wherein the user engageable system further comprises:

a carriage configured to vertically traverse along the vertical support;

a handle extending from the carriage for manipulation by the user; and one or more attachment ports configured to receive one or more user engageable devices.

5. The tilting smith exercise machine of claim 4, wherein the one or more attachment ports comprise a pair of hexagonal ports.

6. The tilting smith exercise machine of claim 1, further comprising:

a vertical latch assembly coupled to the vertical support via a horizontal support, the vertical latch assembly having a plurality of hooks extending inwardly.

7. The tilting smith exercise machine of claim 6, wherein the horizontal support is configured to slidingly engage with the rear angled track when the vertical support pivots from front to back.

8. The tilting smith exercise machine of claim 1, wherein the top trolley further comprises a top tubular guide configured to engage with the upper horizontal rail and the bottom trolley further comprises a bottom tubular guide configured to engage with the bottom horizontal rail, wherein the movable structure is configured to traverse along the upper horizontal rail and the bottom horizontal rail.

9. The tilting smith exercise machine of claim 1, wherein the one or more actuators are gas spring actuators.

10. A movable structure as part of a tilting smith exercise machine, the movable structure comprising:

a vertical support extending from a top end to a bottom end;

a top trolley positioned at the top end of the vertical support, the top trolley having:

a side angled track; and a rear angled track;

a bottom trolley positioned at the bottom end of the vertical support, the bottom trolley having:

one or more actuators extending from the bottom trolley to the vertical support;

a first hinge connecting the bottom trolley to the vertical support to allow the vertical support to pivot from side to side; and a second hinge connecting the bottom trolley to the vertical support and allowing the vertical support to pivot from front to back;

a user engageable system supported by the vertical support;

wherein the top end of the vertical support is supported by the side angled track and the rear angled track when the vertical support is pivoted from side to side and from front to back; and wherein the user engageable system is configured to be operated by a user as the user performs an exercise.

11. The movable structure of claim 10, further comprising a vertical rail extending substantially between the top end and the bottom end, the vertical rail configured to further engage with the top trolley and the bottom trolley.

12. The movable structure of claim 11, wherein the user engageable system is coupled to the vertical support and the vertical rail.

13. The movable structure of claim 10, wherein the user engageable system further comprises:

a carriage configured to vertically traverse along the vertical support;

a handle extending from the carriage for manipulation by the user; and one or more attachment ports configured to receive one or more user engageable devices.

14. The movable structure of claim 13, wherein the one or more attachment ports comprise a pair of hexagonal ports.

15. The movable structure of claim 10, further comprising:

a vertical latch assembly coupled to the vertical support via a horizontal support, the vertical latch assembly having a plurality of hooks extending inwardly.

16. The movable structure of claim 15, wherein the horizontal support is configured to slidingly engage with the rear angled track when the vertical support pivots from front to back.

17. The movable structure of claim 10, wherein the top trolley further comprises a top tubular guide configured to engage with an upper horizontal rail and the bottom trolley further comprises a bottom tubular guide configured to engage with a bottom horizontal rail, wherein the movable structure is configured to traverse along the upper horizontal rail and the bottom horizontal rail.

18. The movable structure of claim 10, wherein the one or more actuators are gas spring actuators.

* * * * *